US006296384B1

(12) United States Patent
Yatomi et al.

(10) Patent No.: US 6,296,384 B1
(45) Date of Patent: Oct. 2, 2001

(54) VERTICAL AGITATING APPARATUS

(75) Inventors: Ryuichi Yatomi; Masafumi Kuratsu, both of Toyo; Masao Yamaoka; Mineo Nakano, both of Kyoto, all of (JP)

(73) Assignee: Sumitomo Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/280,564

(22) Filed: Mar. 30, 1999

(30) Foreign Application Priority Data

Mar. 31, 1998 (JP) ..... 10-103818
Mar. 31, 1998 (JP) ..... 10-103819

(51) Int. Cl.[7] ..... B01F 7/20; B01F 15/06

(52) U.S. Cl. ..... 366/147; 366/270; 366/325.92; 366/329.2; 366/249

(58) Field of Search ..... 366/65, 102, 262, 366/263, 265, 270, 312, 313, 325.92, 325.93, 329.1–329.3, 249, 250, 251, 252, 147

(56) References Cited

U.S. PATENT DOCUMENTS

| | | | |
|---|---|---|---|
| 10,245 | * | 11/1853 | Grover . |
| 274,473 | * | 3/1883 | Dutton . |
| 512,354 | * | 1/1894 | Bangert . |
| 1,737,090 | * | 11/1929 | Meyers . |
| 2,045,919 | * | 6/1936 | Parraga . |
| 4,515,483 | | 5/1985 | Mueller et al. . |
| 4,754,437 | * | 6/1988 | Doom et al. . |
| 5,630,666 | | 5/1997 | Rodriguez . |

FOREIGN PATENT DOCUMENTS

| | | | |
|---|---|---|---|
| 11 82 945 | | 12/1964 | (DE) . |
| 23 63 241 | | 6/1974 | (DE) . |
| 949 301 | | 2/1964 | (GB) . |
| 62-68893 | * | 3/1987 | (JP) . |

OTHER PUBLICATIONS

Abstract of JP 62–068893 Mar. 1987.
Abstract of JP 04–346826 Apr. 1993.

* cited by examiner

*Primary Examiner*—Tony G. Soohoo
*Assistant Examiner*—David Sorkin
(74) *Attorney, Agent, or Firm*—Arent Fox Kintner Plotkin & Kahn, PLLC

(57) ABSTRACT

Provided is a vertical agitating apparatus which can shorten the time of vertically uniform mixing, uniformalize flow rates in the vertical direction, and shorten the time of heat transmission in a deep liquid agitating tank, an agitating tank having a conical bottom part with an acute apex angle of less than 60 deg. or in a tank combination of the former two tanks, and in which a rotary shaft is arranged in the tank so as to be rotatable by a drive located outside of the tank, bottom paddle blades having a large area are attached to the lower part of the rotary shaft, and lattice blades in combination of vertical grids and horizontal arms are provided to the rotary shaft above the bottom paddle blades, the distance between the outer edge of the vertical blades at the outermost end of the lattice blade and the center of the rotary shaft being set so as to be greater than that of the bottom paddle blades.

7 Claims, 7 Drawing Sheets

VERTICAL AGITATING APPARATUS

BACKGROUND OF THE INVENTION

The present invention relates to an agitating apparatus for agitating various kinds of fluids, semisolid fluids, powders or the like in a tank, and in particular to a vertical agitating apparatus adapted to be used in an agitating tank of an acute conical bottom type.

RELATED ART

In an agitating apparatus of this kind, in general, a rotary shaft which incorporates agitating blades and which is journalled in an agitating tank at the center of the latter, the rotary shaft being projected from the tank, and is rotated by a drive located outside of the tank so as to rotate the agitating blades which therefore produce swirling flows and vertically circulating flows in a substance to be processed (substance to be agitated), within the tank in order to agitate and mix the substance. Discharge type swept-back blades such as turbine blades, paddles, propellers and the like, and shearing type agitating blades such as gates, helical ribbon blades, screws or anchors and the like have been conventionally known as the agitating blades.

Referring to FIG. 7, which is a sectional view illustrating an agitating apparatus using conventional two-stage turbine blades as an example, an agitating tank 20 has a bottom part in a conical bottom shape having an apex angle $\alpha$, a rotary shaft 21 adapted to be rotated by a drive outside of the tank, which is incorporated being extended over the overall length of the tank, and one or more agitating blades 23 which are attached to an intermediate part of the rotary shaft 21. The agitating blades 23 discharges liquid toward the peripheral part of the tank through the rotation of the rotary shaft 21, and accordingly, thus obtained discharge flows circulate the liquid within the tank. Coils 24 may be arranged in the inner peripheral part of the tank.

(1) Conventional agitating blades cannot attain vertically uniform mixing in the case of a high depth agitating tank (having a ratio L/D>1.5 where L is a depth from the liquid surface to the bottom of the tank, and D is an inner diameter of the tank). (2) Further, in an agitating tank of an acute-angle conical bottom type having an apex angle less than 60 deg., only a pair of crossarm-like blades 30 similar to agitating blades 23 in a straight barrel part of the tank are provided to the lower part of the rotary shaft 21, as shown in FIG. 7, and a stagnant part 27 of liquid is inevitably generated in the tip end part of the conical bottom part in which no mixing is effected. In particular, in the case of the provision of coils in the peripheral part of the inside of the tank, the above-mentioned deficiencies (1) and (2) become highly remarkable.

Referring to FIGS. 7 to 11, the above-mentioned deficiencies will be explained in detail. If the above-mentioned discharge type agitating blades 23 are used in a single stage, the agitating blades 23 being located normally in the vicinity of TL (a joint line between a cylindrical part and a conical bottom part of the tank), as shown in FIG. 8, and the flowing speed of discharged liquid is retarded on the way of displacement of the discharged liquid in a deep liquid condition (as shown in a part A of FIG. 8) since the distance of displacement from the bottom part 20*a* of the tank to a liquid surface 25 is long. Thus, stagnation occurs in a part B of FIG. 8 and accordingly, vertically uniform mixing cannot be achieved.

In order to eliminate this nonuniform condition, a multi-stage configuration having agitating blades of more than two stages may be used as shown in FIG. 9. However, discharge flows impinge upon one another between blades 23*a* and 23*b* so that the fluid in the tank exhibits as if a partition wall is present in the vertically intermediate part of the tank, as indicated by reference numeral 26, and as a result, the vertical uniform mixing would be rather hindered by this partition wall-like liquid phase.

In the agitating tank 2 of a conical bottom type having an apex angle of less than 60 deg. as shown in FIGS. 7, 10 and 11, the shorter the distance to the conical bottom, the smaller the cross-sectional area, the fluid resistance is likely to occur in flowing fluid. Thus, precisely, the fluid can not reach the tip end of the conical bottom, but it goes in a direction in which the fluid resistance is less. Thus, the so-called flow separation occurs. As a result, the stagnation part 27 of the liquid occurs in the tip end part of the conical bottom, the higher the viscosity of the liquid, the higher this tendency. This stagnation in that part cannot be overcome even by using paddle-like agitating blades 30 in the tank bottom part. It is noted that the hatched parts shown in FIG. 7 exhibits those parts where inferior flow occurs in the liquid.

Further, in an agitating tank using shearing type blades such as gates, helical ribbon blades, screws or anchors, it is said the blades are in general rotated at a low speed for raising and scraping liquid in order to promote mixing of the same. However, in this case, the Reynolds number of liquid flow should be less than Re=100 in order that the shearing blades can exhibit their nominal performance, that is, the liquid flow must fall in a region of laminar flow. Out of this region, the capability of creation of vertical circulation becomes excessively low. That is, if the Reynolds Number exceeds 100, the mixing can hardly occur in the vertical direction. It is noted that the Reynolds number, that is, Re number is exhibited by $d^2n\rho/\mu$, where d (m) is a diameter of an agitating blade, n (1/s) is a rotational speed of blades, $\rho$ (kg/m$^3$) is a density of liquid, and $\mu$ (kg/m·s) is a viscosity of the same.

Further, most of conventional agitating blade shapes and combinations thereof cause fluid to flow upward in the vicinity of the wall surface of a tank (refer to reference numerals 28, 29 in FIG. 7), and accordingly, such conventional blade shapes cannot create an ascending flow at the center of an acute conical bottom of a tank. Further, since the flow speed becomes lower on the way, in the case of deep liquid or a conical bottom, and accordingly, not only one flow but several side flows 28, 29 (isolated from the main stream) would occurs in the tank, and accordingly, the overall uniform mixing in the tank becomes remarkably inferior.

SUMMARY OF THE INVENTION

The present invention is devised in order to eliminate the above-mentioned conventional deficiencies, and accordingly, one object of the present invention is to provide a vertical agitating apparatus which can shorten the time required for vertically uniform mixing, allows the flow rates in the vertical direction to be uniform in an agitating tank such as a deep liquid agitating tank, and can shorten the time of heat transmission, and which can prevent stagnation from occurring in liquid in an agitating tank of a conical bottom type having an apex angle of less than 60 deg. or the like.

According to the first aspect of the present invention, there is provided a vertical agitating apparatus comprising an agitating tank having a center and having a bottom part formed in a conical shape having an apex angle of less than 60 deg., and a rotary shaft attached at the center of the agitating tank, and adapted to be rotated by a drive located outside of the tank, and agitating blades attached to the rotary shaft and having a conical bottom paddle part which are located in the bottom part of the agitating tank and which has a shape along the half apex angle of the conical bottom part of the agitating tank.

According to the second aspect of the present invention, there is provided a vertical agitating apparatus comprising an agitating tank having a center, a rotary shaft having a lower part, arranged at the center of the tank and rotated by a drive located outside of the agitating tank, conical bottom paddle blades and attached to the lower part of the rotary shaft, lattice blades in combination of vertical grids each having an outer edge, and horizontal arms having an outermost side and provided to the rotary shaft on the upper side of the conical bottom paddle blades, the distance between the outer edge at the outermost side of the lattice blades and the center of the rotary shaft is greater than that of the bottom paddle blades.

In addition to the above-mentioned features and advantages of the present invention, other features and advantages of the present invention will be more apparent when the following detailed explanation are read with reference to the accompanying drawings in which:

DETAILED DESCRIPTION OF PREFERRED EMBODIMENT OF THE INVENTION

Figure 1:
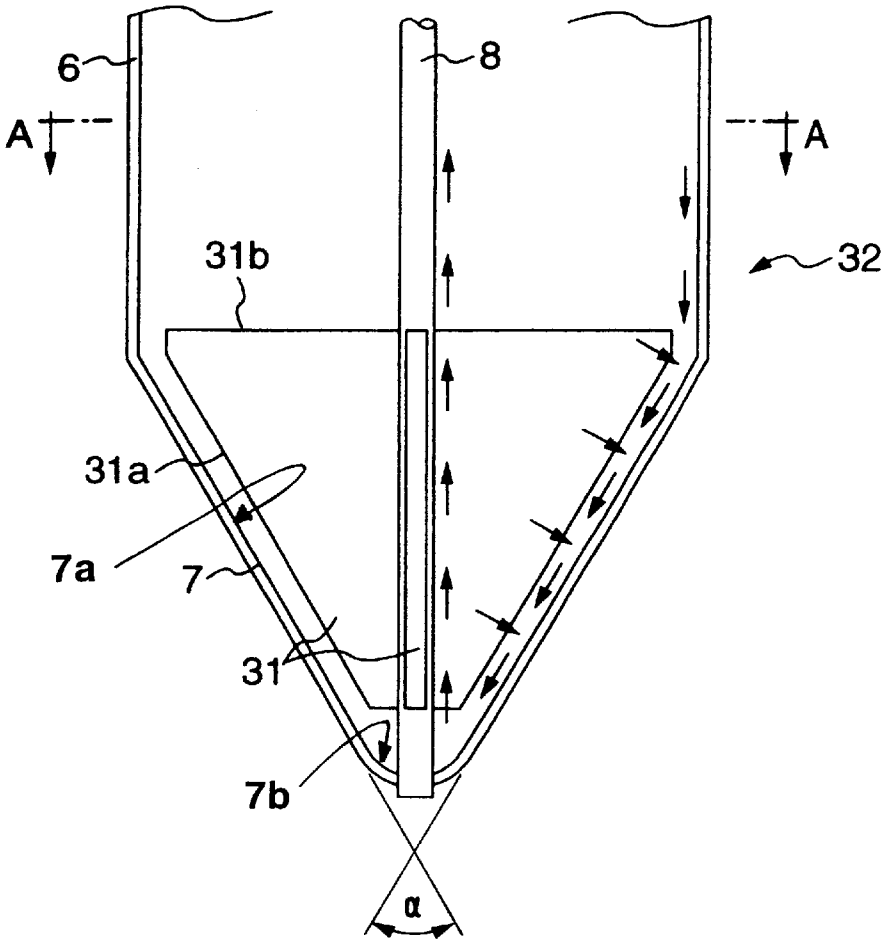
FIG. 1 is a vertical cross-sectional schematic view illustrating a vertical agitating apparatus in an embodiment of the present invention, in which an agitating blade structure having a conical bottom paddle part that is essential in the present invention, is applied to a conical bottom type agitating tank.
Figure 7:
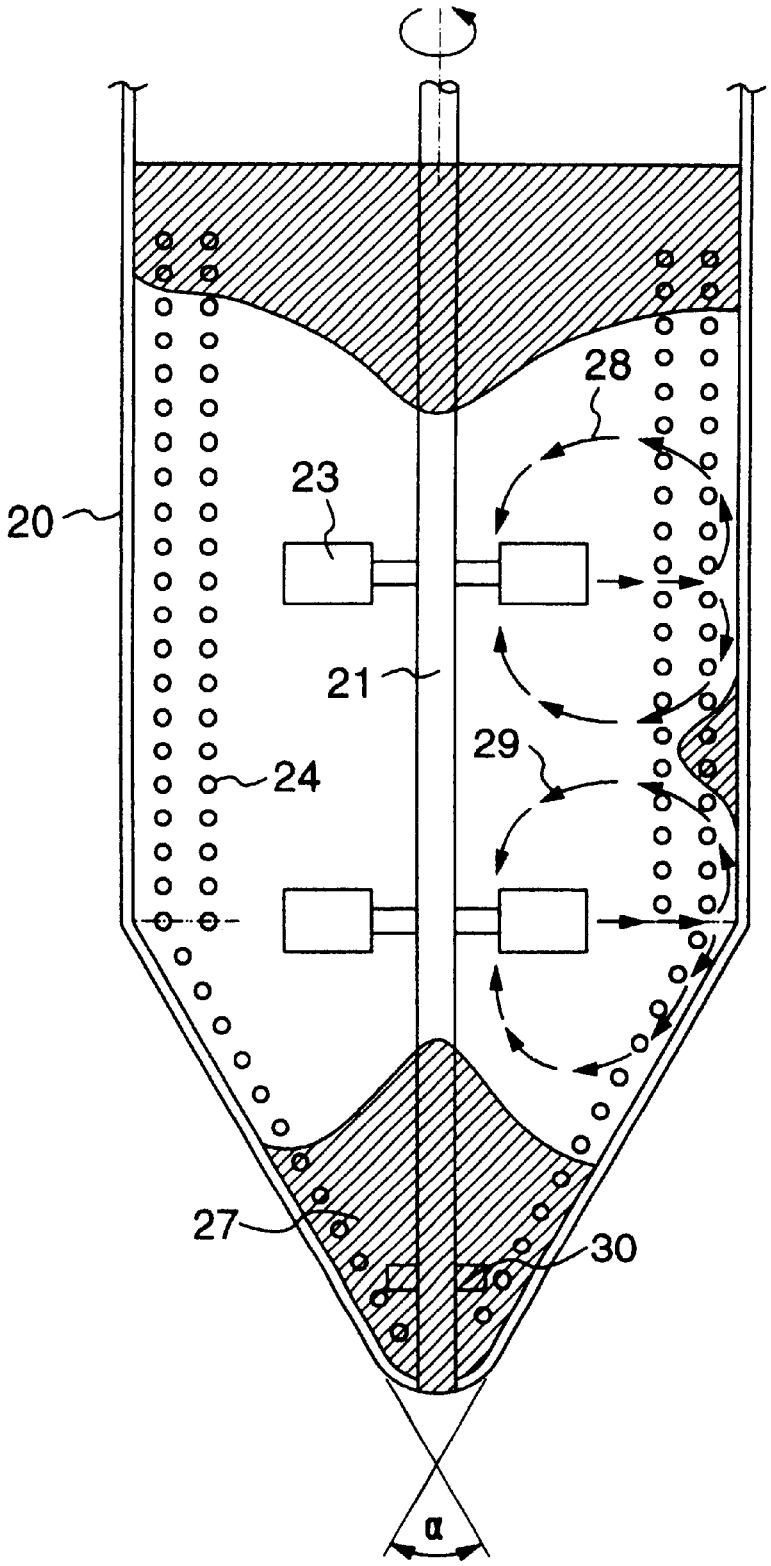
FIG. 7 PRIOR ART
FIG. 7 is a sectional view illustrating a conventional agitating apparatus using two-stage turbine blades.
Figure 8:
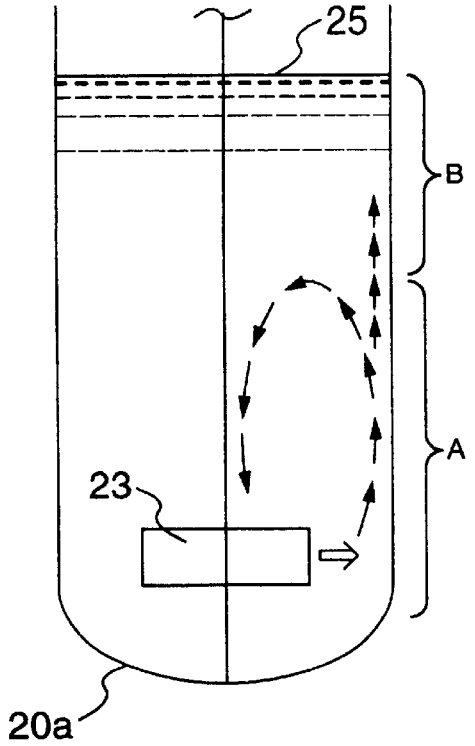
FIG. 8 PRIOR ART
FIG. 8 is a schematic view illustrating a conventional agitating apparatus using discharge type first stage blades.
Figure 9:
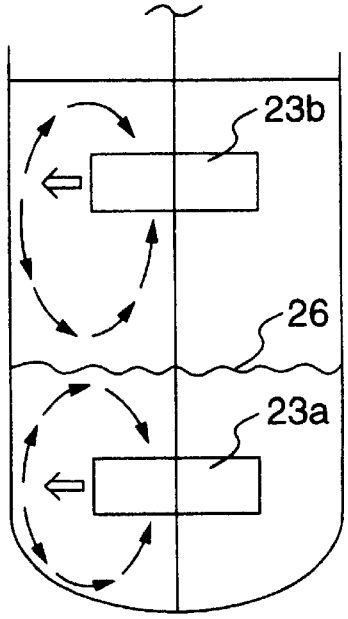
FIG. 9 PRIOR ART
FIG. 9 is a view which shows a state such that liquid is vertically separated in the conventional agitating apparatus using the two-stage blades.
Figure 10:
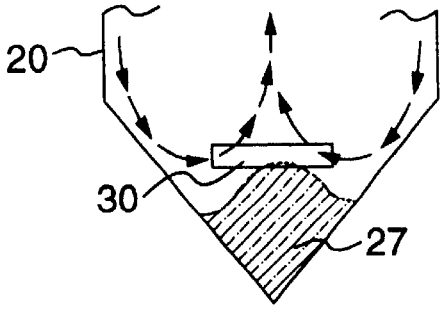
FIG. 10 PRIOR ART
FIG. 10 is a view which shows a state such that a stagnation part of liquid is created in the bottom part of a conventional conical bottom type agitating tank.
Figure 11:
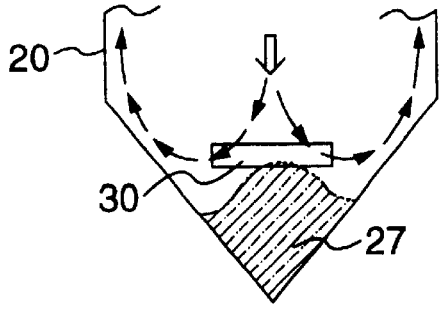
FIG. 11 PRIOR ART
FIG. 11 is a view which shows a state such that a stagnation part of liquid is created in the bottom part of a conventional conical bottom type agitating tank.

Next, detailed explanation will be hereinbelow made of a preferred embodiment of the present invention with reference to the accompanying drawings. Referring to FIG. 1 which is a vertical sectional view illustrating the lower part of a vertical agitating apparatus in a first embodiment of the present invention, agitating blades in this embodiment are composed of a conical bottom paddle part 31 attached to the lower part of an agitating shaft (rotary shaft) 8 and having an area which is greatly larger than that of arm-like agitating blades 30 in the bottom part of a conventional agitating tank shown in FIG. 7. Further, the external shape thereof is such that it is in close proximity with a conical bottom part 7 of an agitating tank 32, and its side part shape 31 is along the half apex angle of the conical bottom part 7. An upper edge 31*b* of the paddle part 31, is located in the vicinity of a boundary between the conical bottom part 7 and a straight barrel part 6 of the agitating tank 32.

Figure 2:
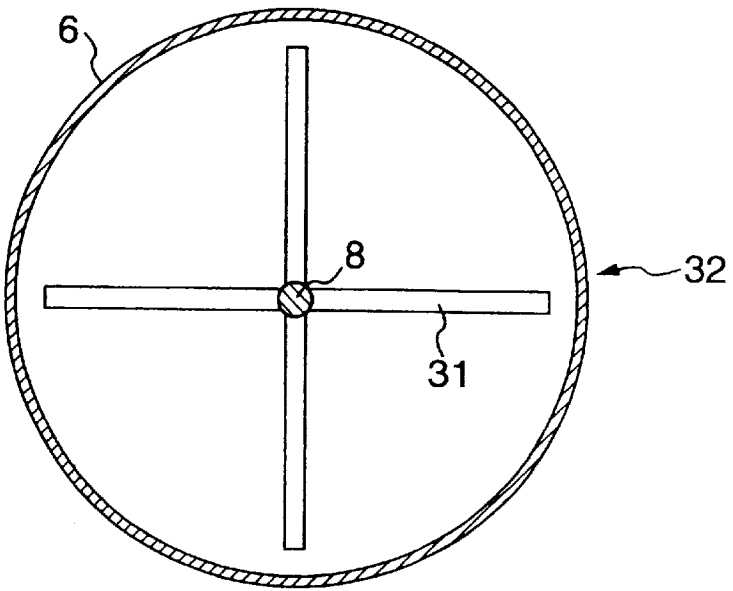
FIG. 2 is a cross-sectional view along line A—A in FIG. 1.

Further, in this embodiment, four agitating blades are arranged at 90 deg. angular pitches around the agitating shaft 8 in the paddle part 31 as shown in FIG. 2. However, the present invention should not be limited to the number of the blades. Accordingly, two agitating blades which are diametrically aligned, or three agitating blades which are arranged at angularly equal intervals, may be used. Although no blades are provided to the agitating shaft above the conical bottom paddle part 31, suitable blades may be attached to the agitating shaft above the conical bottom paddle part 31. Further, the conical bottom paddle part 31 may have such a structure that each of blades in the conical bottom paddle part 31 is inclined, or bent or swept-back. It is noted that the blades in the conical bottom paddle part 31*a* are inclined as view in both vertical and horizontal directions while in the bent conical bottom paddle part they are bent as viewed in the vertical direction, and the blades in the swept-back conical bottom paddle part are curved.

In the embodiment shown in FIG. 1, when the agitating shaft 8 is rotated by a drive source (which is not shown in the drawings) outside of the tank, liquid to be processed is vertically pushed out from the side part 31*a* of the conical bottom part 31, perpendicular to the inner wall 7*a* of the bottom part 7 of the tank by the paddle part 31, and flows downward along an inclined surface of the inner wall 7*a* of the tank. Then, it ascends along the agitating shaft 8 from the tip end part 7*b* of the bottom of the tank in the vicinity of the shaft 8, and then descends again along the inner wall surface of the tank from the intermediate and upper part of the tank 32. As a result, the liquid to be processed, can repeat effective circulation in the tank, thereby it is possible to uniformly mix the liquid to be processed with no stagnation in the bottom part of the tank, which has been conventionally inherent.

Figure 3:
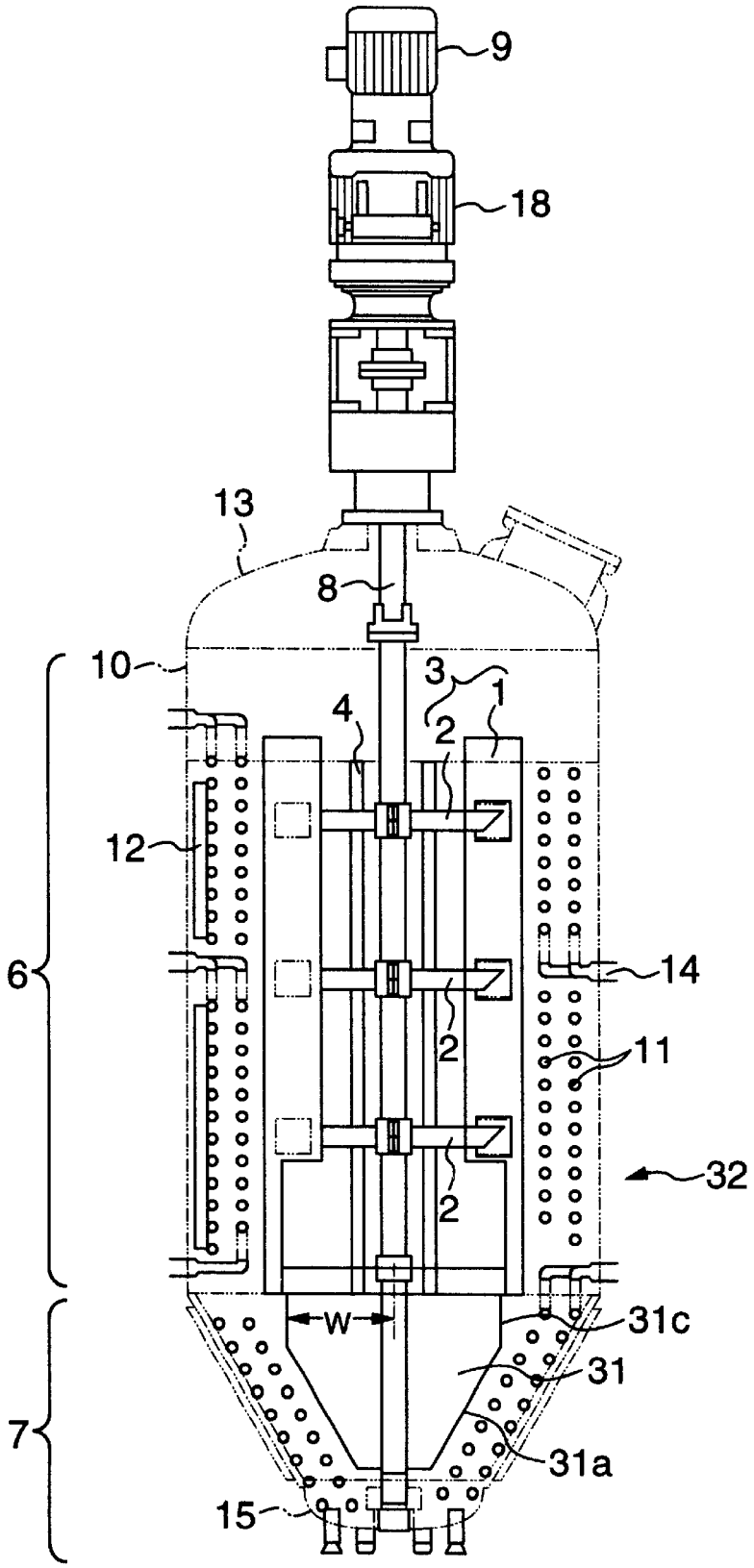
FIG. 3 is a side view illustrating a vertical agitating apparatus in another embodiment of the present invention.

Referring to FIG. 3 which is a side view illustrating an vertical agitating apparatus in another embodiment of the present invention and in which an outer shell of a tank casing 10 is shown by phantom lines for the sake of brevity, an agitating tank 32 has a tank casing 10 comprising a straight barrel part 6, and an inverted conical bottom part 7, and a cover 13 for closing the top part of the straight barrel part 6, and an agitating shaft (rotary shaft) 8 is provided, extending in the enter part of the tank casing 10 from the bottom of the tank, and passing through the cover 13. The agitating shaft 8 projected upward from the cover 13 is coupled to an output shaft of a motor 9 and a speed reducer 18 mounted in the top part of the cover 13, and accordingly, is adapted to be rotated by the motor 9 which is energized. Heat transmission coils 11 are set up by means of suitable coil supports 12 in the vicinity of the inner wall of the tank casing 10, extending from the upper end of the straight barrel part 6 to the lower end of the bottom part 7 of the tank casing 10. In the embodiment as shown, the coils are arranged in double.

However, it may be arranged in single or multiple. Baffles may be provided in the inner wall of the tank casing 10 as required, and the coil supports may also serve as the baffles in the embodiment as shown. It is noted that nozzles 14 are provided for feeding cooling water or heat medium into the coils 11.

The agitating shaft 8 is journalled to the bottom panel 15 of the bottom part 7 and the cover 13 at the top of the tank, and a lattice blade part 3 which will be hereinbelow detailed, is provided, to the agitating shaft 8, extending radially outward therefrom, at a position corresponding to the straight barrel part 6, and a conical bottom paddle part 31 having a large horizontally projected area is attached to the agitating shaft 8 at a position corresponding to the bottom part 7. The agitating blade structure in this embodiment, is composed of the conical bottom paddle part 31 in the bottom part 7 and a lattice blade part 3 in the straight barrel part 6. The conical bottom paddle part 31 has lower side parts 31*a* which is acute so as to extend along the inverted conical shape of the bottom part 7, and has vertical side parts 31*c* in the upper end part thereof. The paddle part 31 may be inclined, bent or swept-back as stated with respect to FIG. 1. In the case of two blades which are aligned diametrically, both lattice blade part 3 and conical bottom paddle part 31 may be arranged in such a way that the vertical grids 1 of the lattice blade part 3 are circumferentially shifted from blades in the conical bottom paddle part 31 by a phase angle of 90 deg.

Figure 4B:
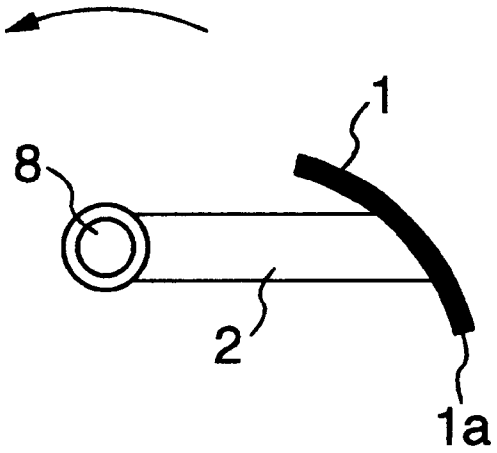
FIGS. 4*a* and 4*b* are plane views illustrating a vertical grid which is attached to a horizontal arm, being inclined and swept-back with respect to the horizontal arm.
Figure 4A:
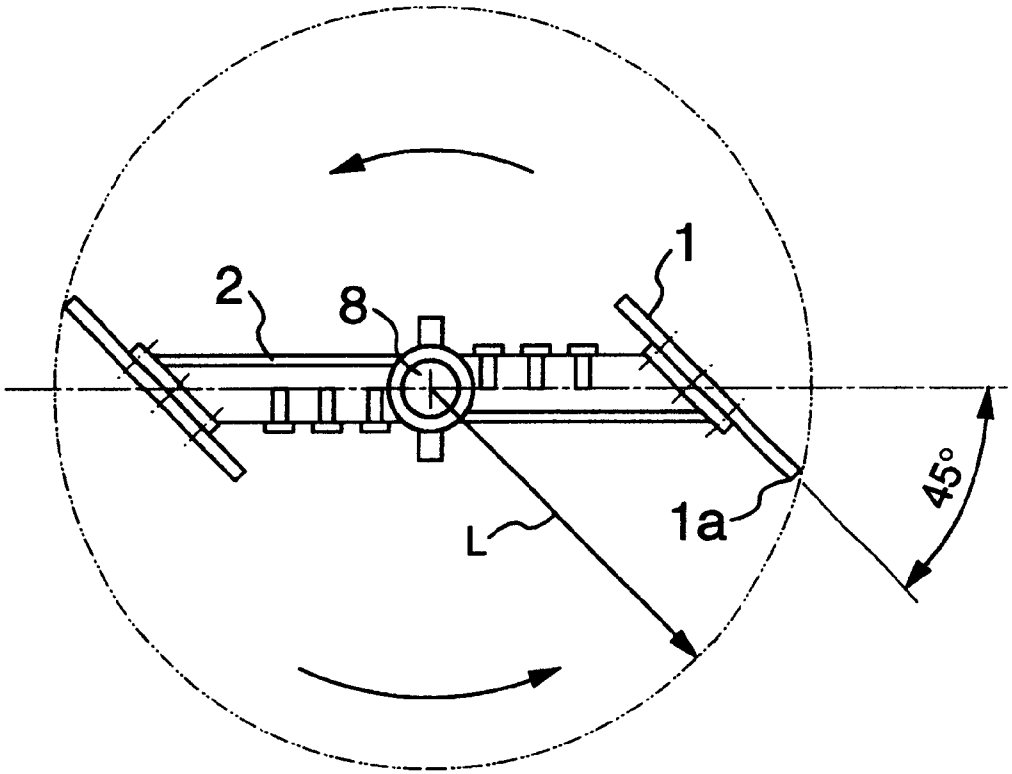
Figure 5A:
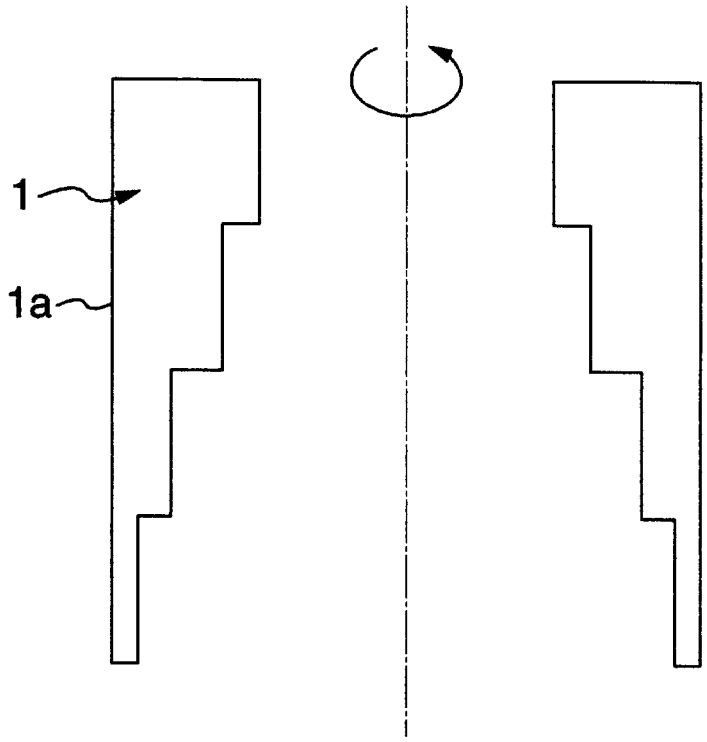
FIGS. 5A and 5B which are front views illustrating examples of configurations in which the width of the vertical grid according to the present invention are changed.
Figure 5B:
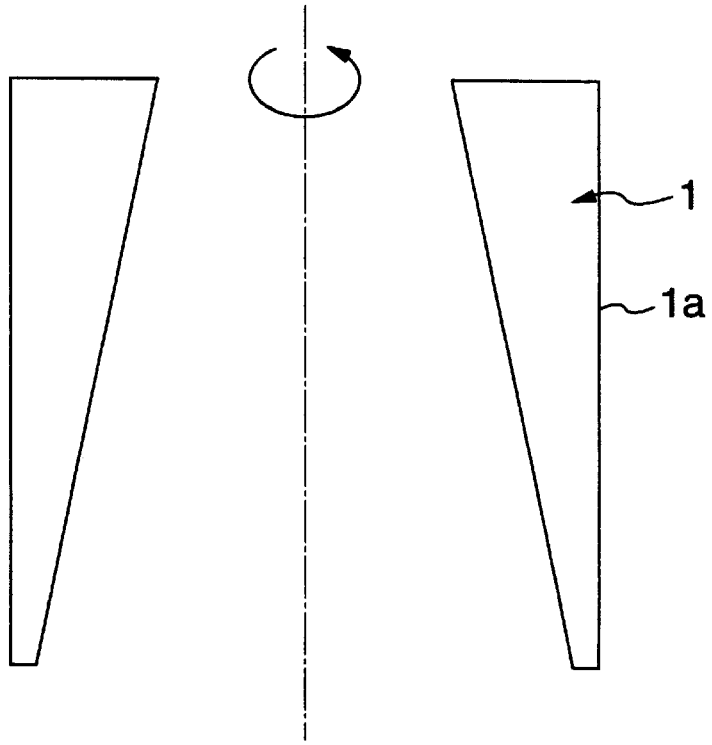

Adjacent to the conical bottom paddle part 31, the lattice blade part 3 attached to the agitating shaft 8 above the conical bottom paddle part 31, is composed of a plurality of horizontal arms 2 attached to the agitating shaft 8, and vertical grids 1 attached to the tip ends of the horizontal arms 2 and extending in parallel with the agitating shaft 8. Referring to FIGS. 3, 4A, 4B, 5A and 5B, the distance L between the outermost edge 1*a* of the vertical grids 1 at the outer end of the horizontal arms 2 and the center of the agitating shaft 8 is greater than the maximum width W (refer to FIG. 3) of one side of the large paddle part 31 attached to the lower part of the rotary shaft. Further each of the vertical grids 1 is formed so as to have as a whole a wide upper part and a narrow lower part. In this arrangement, blades have such a configuration that its lower part is cut out on the inside at a single stage, as shown in FIG. 3, is cut out on the inside at multiple stages so as to successively change stepwise in the vertical direction as shown in FIG. 5A, or is cut out on the inside so as be continuously changed from the bottom to the top thereof, thus it becoming narrower toward the bottom thereof as shown in FIG. 5B.

A single or a plurality of intermediate vertical grids 4 are attached to the horizontal arm 2 between the agitating shaft 8 and the vertical grid 1 at the outermost end of the arm 2. The vertical grid 1 at the outermost end of the arm may be attached so as to be inclined with respect to the flow of liquid as shown in FIG. 4A, or to be swept-back as shown in FIG. 4B. It is noted that any of the arrows shown in FIGS. 4A and 4B indicates in the rotating direction of the agitating shaft 8.

Figure 6:
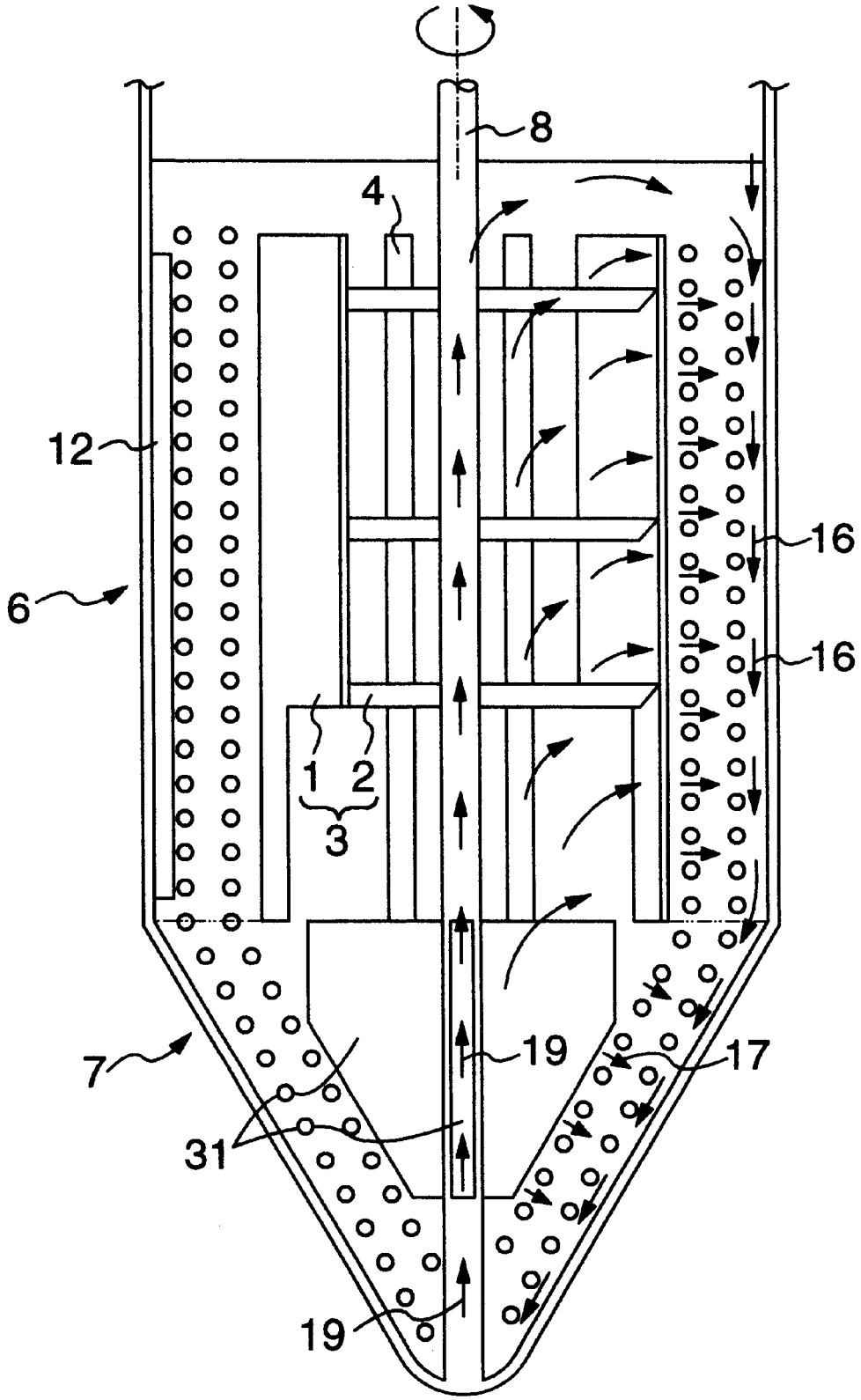
FIG. 6 is a side view graphically illustrating liquid flows during operation of an agitating tank in the embodiment shown in FIG. 3.

Referring to FIG. 6 which is a side view schematically illustrating flows of liquid in the agitating tank during agitation, as viewed laterally in the embodiment shown in FIG. 3. As mentioned above, since the width of the vertical grid 1 is greater in the upper part thereof than that in the lower part thereof, all liquid flows 16 are directed downward in the vicinity of the inner wall surface of the straight barrel part 6 of the tank. The side parts 31*a* of the large size paddle part 31 extend along the conical bottom part 7 from a position near to the top to the bottom thereof, and accordingly, flows 17 of liquid directed toward the bottom wall of the tank are created in this part while an effect of feeding the liquid upward from the bottom part is obtained (indicated by reference numeral 19) at the center of the paddle part 31. In combination of the downward flows 16 on the wall surface side of the straight barrel part with the action of the large paddle part 31 for sucking up the liquid in the bottom part 7 of the tank with no interference therebetween, a circulating flow in the form of the so-called one stroke of the brush (flow continuous with no auxiliary flows) can be created, thereby it is possible to shorten the time of mixing uniform throughout the tank, and to uniformalize flow rates throughout the tank.

Further, according to the present invention, since the bottom paddle part 31 including blades having a large projected area is provided below the lattice blade part 3, the suck-up action of the large size blades in the conical bottom paddle part can be effected so that no stagnation parts is created in the tip end part of the bottom part of the tank, thereby it is possible to carry out vertically uniform mixing even though the agitating tank as a conical bottom part having an acute apex angle of less than 60 deg.

Further, even in such a case that the agitating tank has the bottom part of a conical shape having an apex angle of less than 60 deg., and has a deep liquid depth (the proportion L0/D between the liquid depth L from the bottom to the liquid surface and the diameter D of the tank is larger than 1.5), the range of liquid volume which can be carried away, is broad, coping with a liquid volume down to 1/200 of the maximum liquid volume. That is, the agitating apparatus according to the present invention can cope with the variation in the liquid volume which is large so that the liquid volume during operation can be finally increased up to 200 if the initial value is set to 1, by using only one agitating tank, in comparison with a conventional one in which two large and small size tanks must be used in combination.

In the case of the agitating tank with coils, if the outer diameter of the vertical grids in the upper lattice blade part according to the present invention is set to a value greater than 0.7 dc with respect to the winding diameter dc of the inner coils 11 so that the vertical grids are arranged adjacent to the coils 11, the flow rates of liquid in the vicinity of the heat transmission jacket or the coils become remarkable higher than these obtained by conventional agitating blades, due to the discharge flows from the blades, and as a result, it is possible to remarkably enhance the heat transmission function.

Although the explanation has been made in the above-mentioned embodiments so that the bottom part of the agitating part is an acute conical bottom part, the present invention should not be limited to theses embodiments. However, the agitating tank may only have a straight barrel if the lattice blade part 3 with no conical bottom paddle part is used. In this case, the flow of liquid drawn by the so-called single stroke of the brush can also be obtained in the overall tank, and it is possible to shorten the time of vertically uniform mixing in the tank, and to unifomlize flow rates in the vertical direction, and to shorten the time of heat transmission.

As mentioned above, with the provision of the conical bottom paddle part extending along the conical bottom of the agitating tank and having a large area, to the lower part of the shaft in the bottom part of the tank, satisfactory agitating can be obtained with no stagnation in liquid to be processed in the bottom part of the tank. Further, in such a case that an additional lattice blade part is provided above the conical bottom paddle part, the width of the vertical grids in the lattice blade part is set such that the upper part thereof is wider than the lower part thereof, and further, the diameter of the vertical grids at the outermost edge thereof, is greater than that of the paddle part. Thus, downward liquid flows are created along the inner wall surface of the straight barrel part of the tank while the liquid in the bottom part is sucked up by the large paddle part in the conical bottom part of the tank so that the circulation drawn by the single stroke of the brush in which it flows downward in the vicinity of the wall surface of the tank can be created. Thereby it is possible to effect such advantages that the time of vertically uniform mixing can be shortened, flow rates can be uniformalized in the vertical direction and the time of heat transmission can be shortened, in the agitating tank having a conical bottom part with an apex angle of less than 60 deg.

What is claimed is:

1. A vertically agitating apparatus comprising an agitating tank having a center and having a cylindrical part with a top edge, and a conical bottom part connected to the cylindrical part along a boundary therebetween, and having an acute apex angle, a rotary shaft having an upper part and a lower part and arranged at the center of the tank so as to be rotated by a drive, bottom paddle blades attached to the lower part of the rotary shaft, each of said bottom paddle blades having a paddle surface which extends across a half of the apex angle of the conical bottom part and vertically extends up to the boundary between the cylindrical part and the conical bottom part, which has an external shape that is along a half of the apex angle of the conical bottom part, and which has an upper edge vertically located in the vicinity of the boundary, the lattice blades arranged in the cylindrical part, attached to the upper part of the rotary shaft, and composed of vertical grids each having an outer edge part, and horizontal arms supporting the vertical grids, each vertical grid having a blade surface which vertically extends substantially by a length from the top of the cylindrical part to the boundary, and which extends radially of said cylindrical part from the center thereof, wherein a distance between the outer edge part of the vertical grids, and the center of the rotary shaft is larger than a distance between the center of the rotary shaft and an outer end of the top edge of each of the bottom paddle blades, and the blade surface of each vertical grid having a radial width which is larger in the upper part thereof than in the lower part thereof.

2. A vertically agitating apparatus as set forth in claim 1, wherein the vertical grids having a width which is set so that the upper part thereof is wider than the lower part thereof.

3. A vertically agitating apparatus as set forth in claim 1 or 2, wherein the vertical grids at the outermost end of the lattice blades are inclined circumferentially of the agitating apparatus, with respect to the horizontal arms.

4. A vertically agitating apparatus as set forth in any one of claims 1 or 2, wherein the vertical grids at the outermost end of the lattice blades, are curved and inclined, circumferentially of the apparatus, along flows of agitated liquid, with respect to the horizontal arms.

5. A vertically agitating apparatus as set forth in claim 1, wherein said apex angle is less than 60 deg.

6. A vertically agitating apparatus as set forth in claim 1, wherein a heat-exchanging means is arranged along the inner surface of the cylindrical part.

7. A vertically agitating apparatus as set forth in claim 6, wherein said heat-exchanging means is a coiled pipe.

* * * * *